US007231728B2

(12) United States Patent
Darby

(10) Patent No.: US 7,231,728 B2
(45) Date of Patent: Jun. 19, 2007

(54) HEALING SHOE OR SANDAL

(75) Inventor: H. Darrel Darby, Huntington, WV (US)

(73) Assignee: Darco International, Inc., Huntington, WV (US)

( * ) Notice: Subject to any disclaimer, the term of this patent is extended or adjusted under 35 U.S.C. 154(b) by 433 days.

(21) Appl. No.: 10/019,669

(22) PCT Filed: Apr. 30, 2001

(86) PCT No.: PCT/US01/11737

§ 371 (c)(1),
(2), (4) Date: May 13, 2002

(87) PCT Pub. No.: WO01/82734

PCT Pub. Date: Nov. 8, 2001

(65) Prior Publication Data

US 2002/0178621 A1 Dec. 5, 2002

Related U.S. Application Data

(60) Provisional application No. 60/201,758, filed on May 4, 2000.

(51) Int. Cl.
*A43B 7/14* (2006.01)

(52) U.S. Cl. ..... 36/110; 36/44; 36/100; 36/88

(58) Field of Classification Search ..... 36/110, 36/88, 43, 44, 45, 100, 101, 93, 95

See application file for complete search history.

(56) References Cited

U.S. PATENT DOCUMENTS 2,389,032 A 11/1945 Donnelly (Continued)

*Primary Examiner*—Marie Patterson
(74) *Attorney, Agent, or Firm*—Sughrue Mion, PLLC

(57) ABSTRACT

A medical shoe for use in supporting a patient's foot and a method of using same, the medical shoe comprising an out sole, an upper assembly secured to and partially surrounded by the out sole and an insole assembly substantially enclosed by the outsole and the upper assembly. The outsole having a base portion generally corresponding with the plantar aspect of a human foot and of varying thickness and having a substantially rectangular opening in a top surface of the base portion thereof adapted for accommodating a metatarsal shank. The out sole having a circumferential counter portion extending upward circumferentially from the top surface of the base portion thereof around the base portion of the outsole thereby providing a cavity in the outsole. The upper assembly adapted to surround at least the heel, sides and dorsal portions of the human foot. The upper assembly attached to the top surface of the base portion of the outsole and the circumferential counter of the outsole, and extending in a dorsal direction from the top surface of the base portion of the outsole along the circumferential counter. The insole assembly having a plurality of insole layers disposed in the outsole cavity and surrounded by the upper assembly and the outsole circumferential counter. The plurality of insole layers provided to include a first insole layer, a second insole layer a third insole layer and a fourth insole layer wherein the first and second layers are an Ethyl Vinyl Acetate (EVA) material and the second layer has a durometer less than the first layer, the third layer is a Poron material with a durometer less than the second layer, and the fourth layer is an EVA material with a durometer less than the third layer, and the first, second, third, and fourth layers may be assembled in any order as determined by a health care provider.

38 Claims, 8 Drawing Sheets

U.S. PATENT DOCUMENTS 3,442,031 A * 5/1969 Antell ..... 36/97
4,567,678 A 2/1986 Morgan et al.
4,793,078 A 12/1988 Andrews
4,813,157 A * 3/1989 Boisvert et al. ..... 36/44
4,897,938 A * 2/1990 Otsuka ..... 36/88
5,154,682 A * 10/1992 Kellerman ..... 36/44
5,329,705 A 7/1994 Grim et al.
5,370,133 A 12/1994 Darby et al.
5,452,527 A 9/1995 Gaylord
5,491,909 A 2/1996 Darby
5,799,414 A * 9/1998 Kellerman ..... 36/44

* cited by examiner

HEALING SHOE OR SANDAL

This application is a national stage application of PCT/US01/11737, which was filed on Apr. 30, 2001, and which claims benefit to U.S. Provisional Application No. 60/201,758, which was filed on May 4, 2000.

BACKGROUND DESCRIPTION OF THE INVENTION

1. Field of the Invention

The present invention pertains to a shoe or sandal specifically designed to aid in the offloading, or reducing weight or pressure, from a specific area of the foot. The shoe or sandal, and specifically the insole and outer covering of the shoe upper, are designed to be altered by or under the direction of the health care provider to either offload weight from the bottom of the foot or to remove or reduce pressure from the sides, top or other specific areas of the foot.

The incidence of foot ulcers, infections and deformities of the feet has become an increasing problem as the life expectancy of patients with diabetes and other chronic diseases increase. The cost of treatment of these complex foot problems has escalated to the point that the Center for Disease Control and others in the health delivery system are placing a special emphasis on finding more effective ways of treating these problems. Patients with circulatory problems, diabetes, AIDS, arthritis neuropathies and other debilitating diseases experience complications that lead to increased deformities in the feet subjecting the deformed areas to increased pressures and friction. Spinal cord injuries and other injuries to the back and lower extremities may cause neuropathies that in turn produce deformities in the toes and feet with a loss of feeling causing more complications to develop. Chemically induced neuropathy from chemotherapy, alcohol, drug abuse, etc., may also lead to ulcerations and lesions of the feet that require special care. All of these problems are exacerbated by weight bearing pressure or friction from conventional shoes. Regardless of how aggressive the treatment plan, the use of expensive antibiotics, local wound care, surgery etc., healing is delayed and the lesions and infections reoccur unless effective measures are taken to redistribute weight reducing pressure and friction from the involved foot lesions.

2. Description of the Related Art

Orthotics (othopedic inserts) for supporting certain aspects of the human foot are well known in the field of podiatric medicine. However, orthotics can produce added pressure on the supported areas and cause rubbing which may lead to blistering or other ailments, complicating the above-described problems. Orthotics require additional space when used in conjunction with standard insoles and may even require extra space when comprised in a customized insole. Thus, when used in normal mass market shoes, orthotics can also cause rubbing on opposite surfaces of the foot, due to reduced clearance between foot and the shoe upper. Othopedic shoes such as those manufactured by Markell® and others provide extra depth to accommodate foot deformities and/or orthotics, but have an extremely awkward appearance, generally having a much higher profile (taller appearance) than normal mass-market shoes, and can be unstable when multiple inserts are used.

The wound care shoe system is designed to produce a foot friendly environment where pressure and friction are reduced allowing healing to take place and to reduce the incidence of reoccurrence of a lesion. The invention provides an easy to use healing shoe or sandal and an effective method to offload weight from a particular area of the plantar aspect (bottom) of the human foot by using alterable insoles or insole layers of varying densities and degrees of firmness which fit into an area surrounded by a circumferential counter, in order to hold the insole layers in position. This creates a low profile more stable shoe than prior art extra depth shoes. The outer covering of the upper is also constructed of materials that can be cut out or heat molded or otherwise altered to reduce friction and/or pressure from the non-weight bearing areas of the foot.

SUMMARY OF THE INVENTION

The above and other objects of the invention, which will become apparent hereinafter, are achieved by the provision of an adjustable sandal or shoe with the upper constructed of a combination outer cover, preferably of leather, with an inner liner preferably of EVA or Plastizote, or similar material. This upper permits small portions of the outer cover over a lesion or bony prominence to be cut away leaving the underlying moldable liner of EVA for protection without destroying the integrity of the shoe. This removes the friction and pressure from the area over the lesion permitting faster healing. An out sole, including a base portion having a rocker bottom and a circumferential counter are molded in one piece providing a cavity with space for the various layers of insole material as well as stabilizing the insoles within the cavity of the outsole. The insoles are fabricated of soft, medium and firm density EVA or other suitable materials that mold to the foot. Certain sections of the insoles can be ground down or cut away, to redistribute weight away from a lesion or areas of excessive pressure. The insoles are either heat or pressure moldable. A fitting marker is also located on the medial side of the out sole in order to aid the health care provider in proper shoe fitting.

BRIEF DESCRIPTION OF THE DRAWINGS

FIG. 2 also illustrates a rocker bottom out sole which improves ambulation while reducing weight bearing pressure from the heel and forefoot as well as reducing friction within the shoe from foot movement, and a foam-padded collar designed to reduce pressure and provide comfortable fit around the heel and ankle.

DETAILED DESCRIPTION OF THE INVENTION

Figure 2:
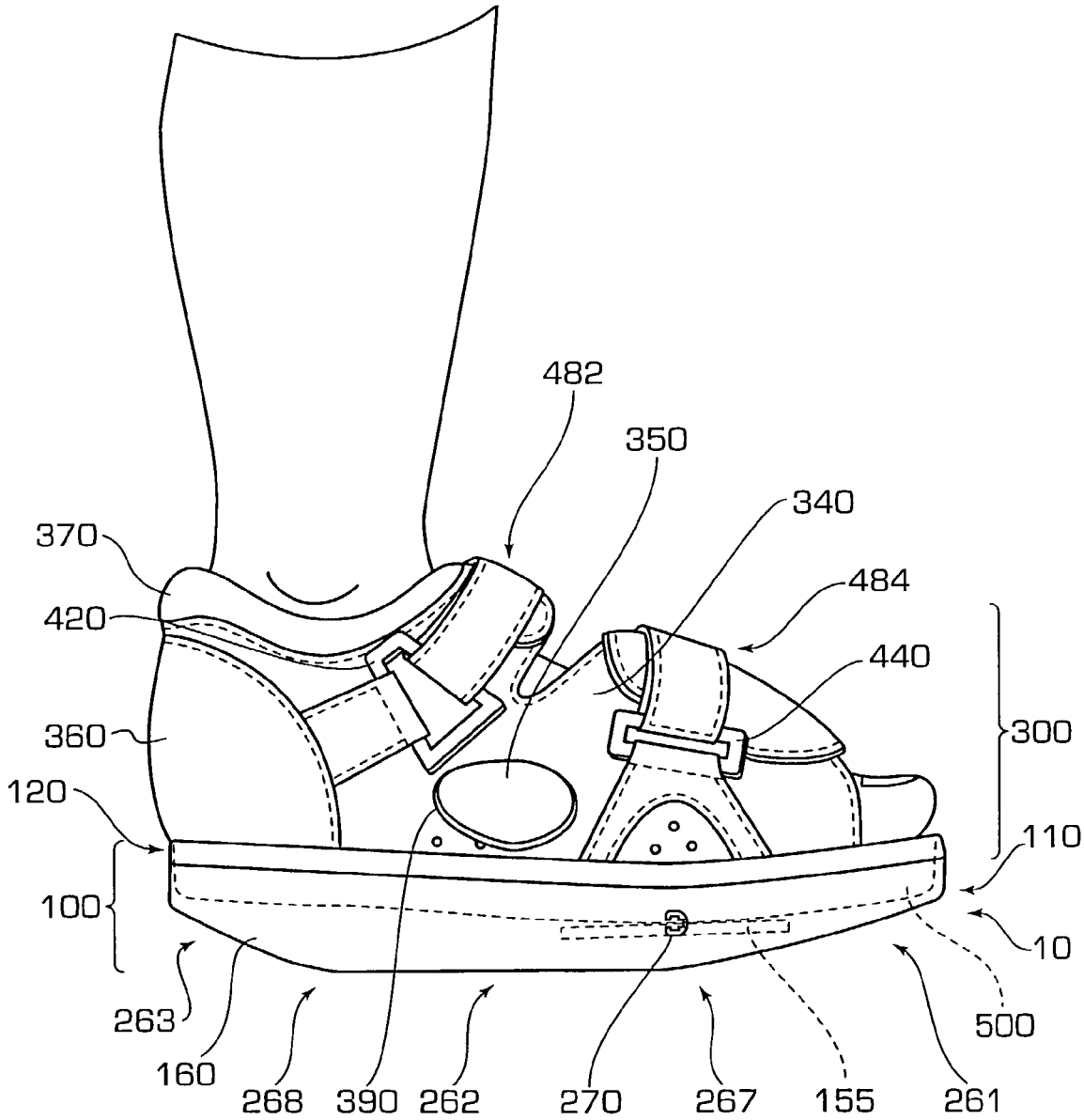
FIG. 2 is a medial side elevation of the wound care shoe illustrating a fitting marker molded on the side of the out sole, and an upper composed of an outer covering and a lining with the outer covering cut away to expose the lining and remove pressure from an ulcer or other lesion while the underlying soft lining remains in place to provide protection while reducing pressure over the lesion.

A sandal or shoe 10 for use by health care professionals in the treatment of infections, ulcerations, and other conditions of the foot, due to complications of diabetes or other medical conditions such as rheumatoid arthritis, vascular conditions, neuropathy, or due to trauma of the feet from a variety of causes, in which it is desirable to redistribute weight away from the infected or traumatized area to be treated. The design (as shown in FIG. 2) of the sandal or shoe 10 includes a molded out sole 100, an upper portion 300, and an adjustable insole 500.

The shoe is designed to accommodate the use of layers of various insole materials generally of a microcellular foam, but not limited to such, including without limitation Plastizote (Plastizote is a medically inert, high density polyethylene closed cell foam having excellent memory and impact absorption properties), Ethylene Vinyl Acetate (E V A), Poron (Poron is a impact absorbing open cell cellular urethane foam product), or similar material, to offload specific areas of the foot in order to promote healing of fractures, ulcers or infections when healing may be delayed by weight bearing pressure on the lesion.

The molded out sole may be constructed from any suitable material including without limitation Ethylene Vinyl Acetate (E V A); polyurethane or other plastic or thermoplastic; rubber, including thermoplastic rubber (TPR), styrene butadiene rubber and natural rubber; or combination thereof. The out sole includes a base portion and a circumferential counter portion. The circumferential counter is molded as a part of the out sole extending completely around an upper portion of the circumference of the out sole. The circumferential counter extends upward from the upper surface of the base portion of the out sole, over an upper portion of the shoe from ¼ to 1 inch.

The circumferential counter extends around the circumference of the top portion of the out sole and forms an opening, cavity, depression or pocket that allows the upper portion of the shoe to be conjoined with or counter sunk into the out sole. This permits extra depth in the upper portion of the shoe in which a variety of insole layers can be placed. The shoe, despite the extra depth, will have a lower profile than the prior art because the extra depth is within the out sole rather than the shoe upper. The cavity within the out sole of the shoe will provide a lower profile more like a conventional shoe while at the same time providing the extra room necessary to accommodate the multi-density insoles or insole layers.

Various types and thickness of insole material such as EVA can be placed in the cavity portion of the out sole of the shoe and may be altered by either grinding or cutting away particular sections to remove weight or provide offloading of the specific area of the foot being treated. The cavity in the out sole permits the application of insole material below the level of the top of the circumferential counter thereby providing greater stability for the (human) foot and preventing the layered insole material from shifting as occurs in conventional shoes and particularly conventional extra depth shoes, if a layered insole is placed in a conventional extra depth shoe where the extra depth (and therefore the layered insole material) is above the out sole level.

Figure 4:
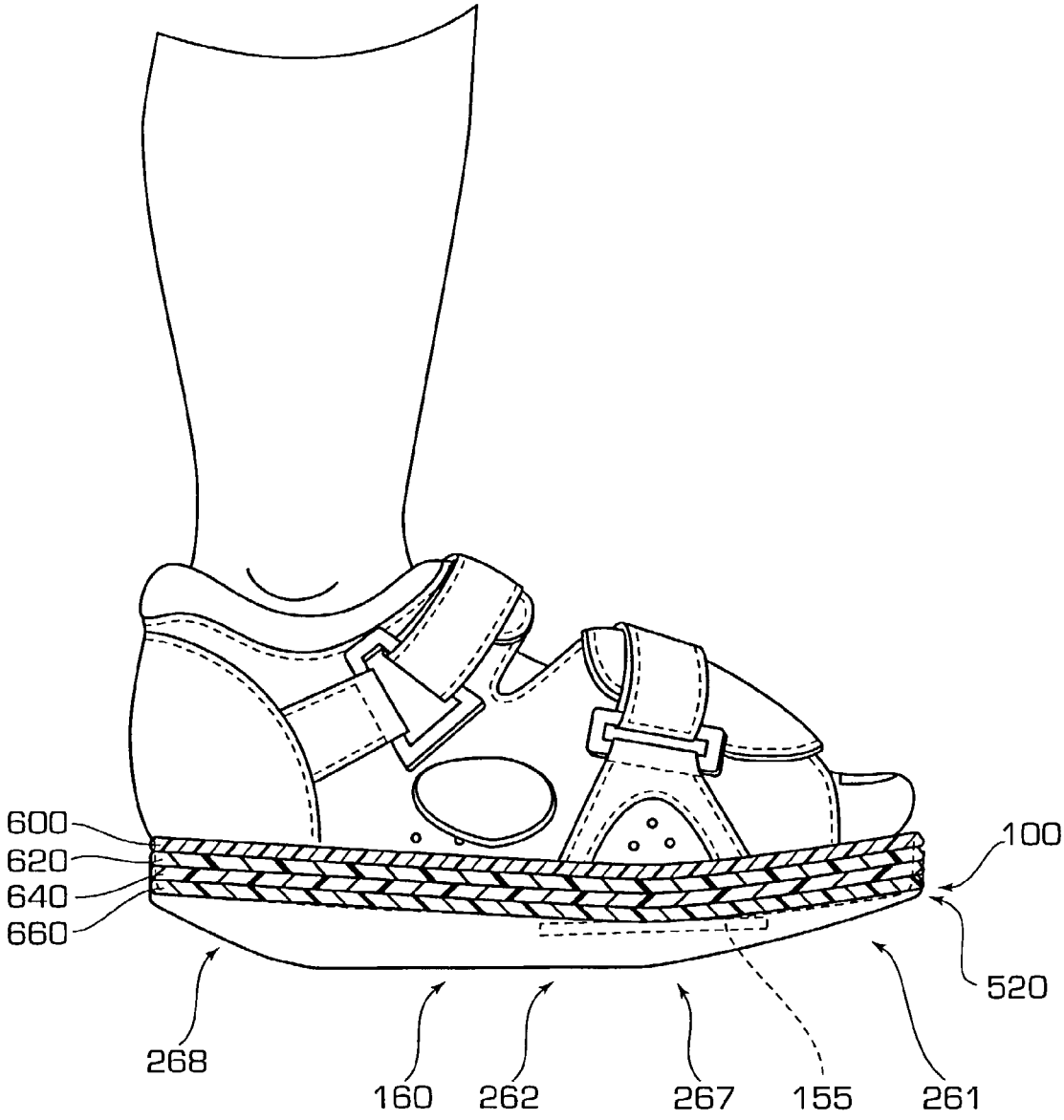
FIG. 4 is a longitudinal cross section of the wound care shoe illustrating the insole layers, metatarsal shank within the outsole and circumferential counter.

The upper surface of the base portion of the out sole (inside the cavity) has a small rectangular opening or trough to accommodate a plastic or metal shank (metatarsal shank). The metatarsal shank (155), as shown in FIG. 4, begins at a location corresponding approximately with the distal ⅓ of the metatarsals (710, as shown in FIG. 5) of a human foot (700) encased by the shoe or sandal as viewed from the plantar aspect (near the axial center of the outsole of the shoe), and extends distally (axially) across the metatarsal-phalangel joints (phalanges (750) shown in FIG. 5) of the foot (700) as viewed from the plantar aspect. The metatarsal shank reduces motion in the shoe and in the corresponding portion of the foot, as well as adds strength to the out sole.

Figure 1:
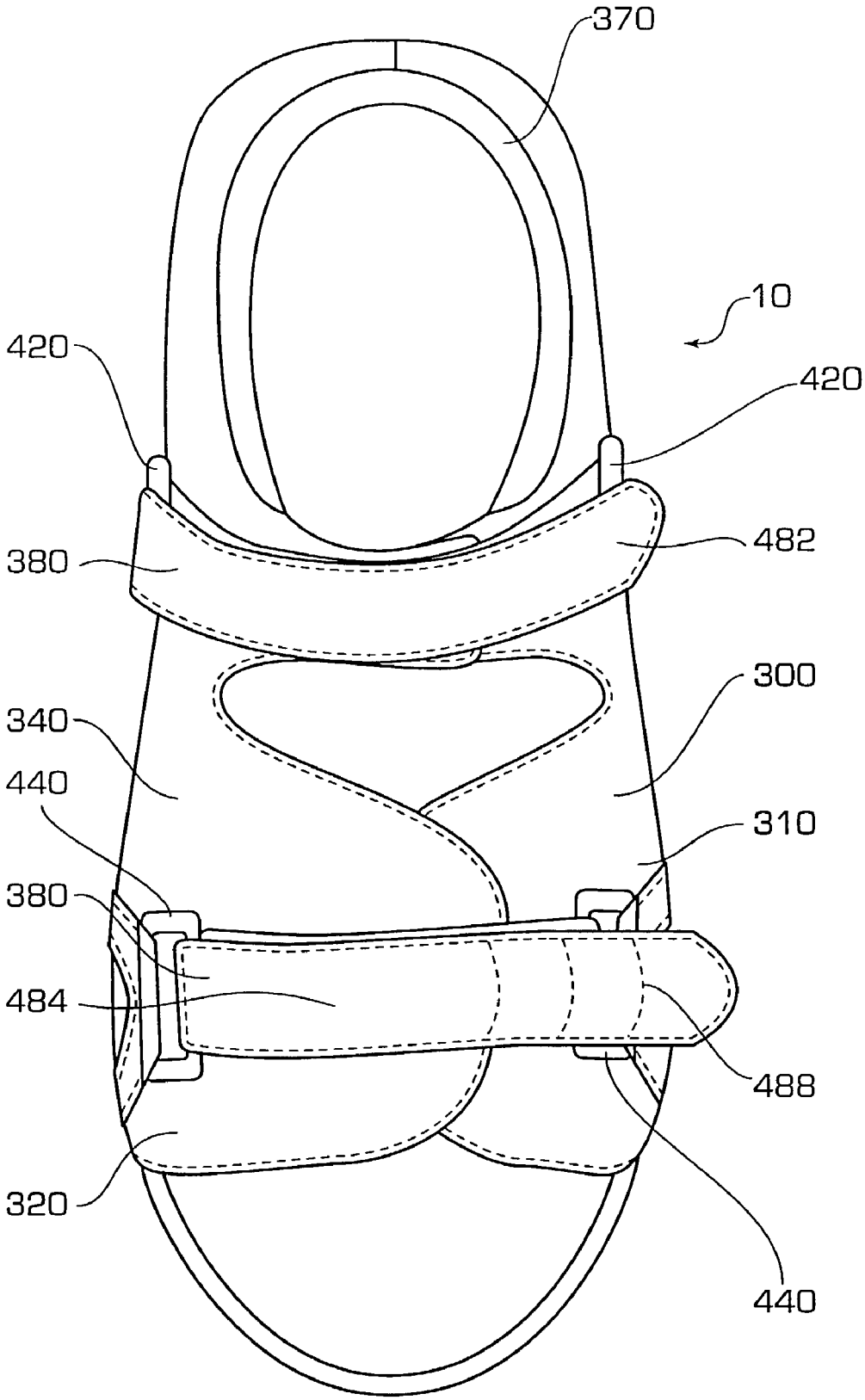
FIG. 1 is a top and front elevation of the wound care sandal or shoe forming a preferred embodiment.

With reference to FIG. 1 the upper 300 of the shoe 10 is closed around the human foot 700 (as shown in FIG. 5) by overlapping inner 310 and outer 320 flaps secured by any of fastening means including but not limited to: buttons and corresponding button holes, snaps, eyelet holes with interconnecting laces, or patches of a hook and loop material (e.g., VELCO®). An additional and preferred alternative is interconnection of the overlapping inner 310 and outer 320 flaps using hook and loop straps (generally, 380). One strap closes in front of the ankle (a first or ankle strap 482) to lock the heel in position to reduce slipping of the heel in the shoe. The second (forefoot) strap 484 fastens over the forefoot to hold this portion of the foot in place. Each flap includes a first (ankle) ring 420 corresponding to the ankle strap 482 and a second (forefoot) ring 440 corresponding with the forefoot strap 484. The ankle 420 and forefoot 440 rings are positioned directly across (transversely) from one another and the respective strap (482 or 484) is threaded through the respective pair of rings (420 or 440) and secured, thereby securing the inner 310 and outer 320 flaps in place by applied pressure and tension (between the ring pairs). Additionally, the straps 380 may be stitched at intervals 484, to permit shortening of the straps as edema subsides or the bulk of bandages are reduced. The straps are cut in front of the appropriate stitch line 488 to prevent fraying of the straps.

As illustrated in FIG. 2, the shoe upper 300 is constructed of an outer covering 340 of leather, canvas, nylon mesh or other suitable material with an inner lining 350 of EVA or soft foam material that can be easily separated from the outer covering. The inner lining 350 reduces friction against the non-weight bearing surfaces of the foot while providing increased comfort. This construction allows the removal of a specific section of the outer covering (as shown at 390 in FIG. 2) over a pressure point or lesion leaving the soft, heat or pressure moldable inner lining 350 (EVA), in place over the ulcer or prominence for protection. There is also a foam-padded collar 370 around the heel and ankle portion (heel portion or heel counter 360) of the shoe or sandal 10, to prevent pressure from the outer covering 340 material and reduce heel slippage. To assist the health care provider in proper fitting of the shoes a fitting marker 270 is molded into the medial side of the out sole 100. The end of the first metatarsal 710 generally should extend slightly in front of the fitting marker 270 to reduce pressure under the metatarsal heads 720 (as shown in FIG. 5) and permit the rocker bottom out sole 160 (as discussed below) to perform properly.

Figure 3:
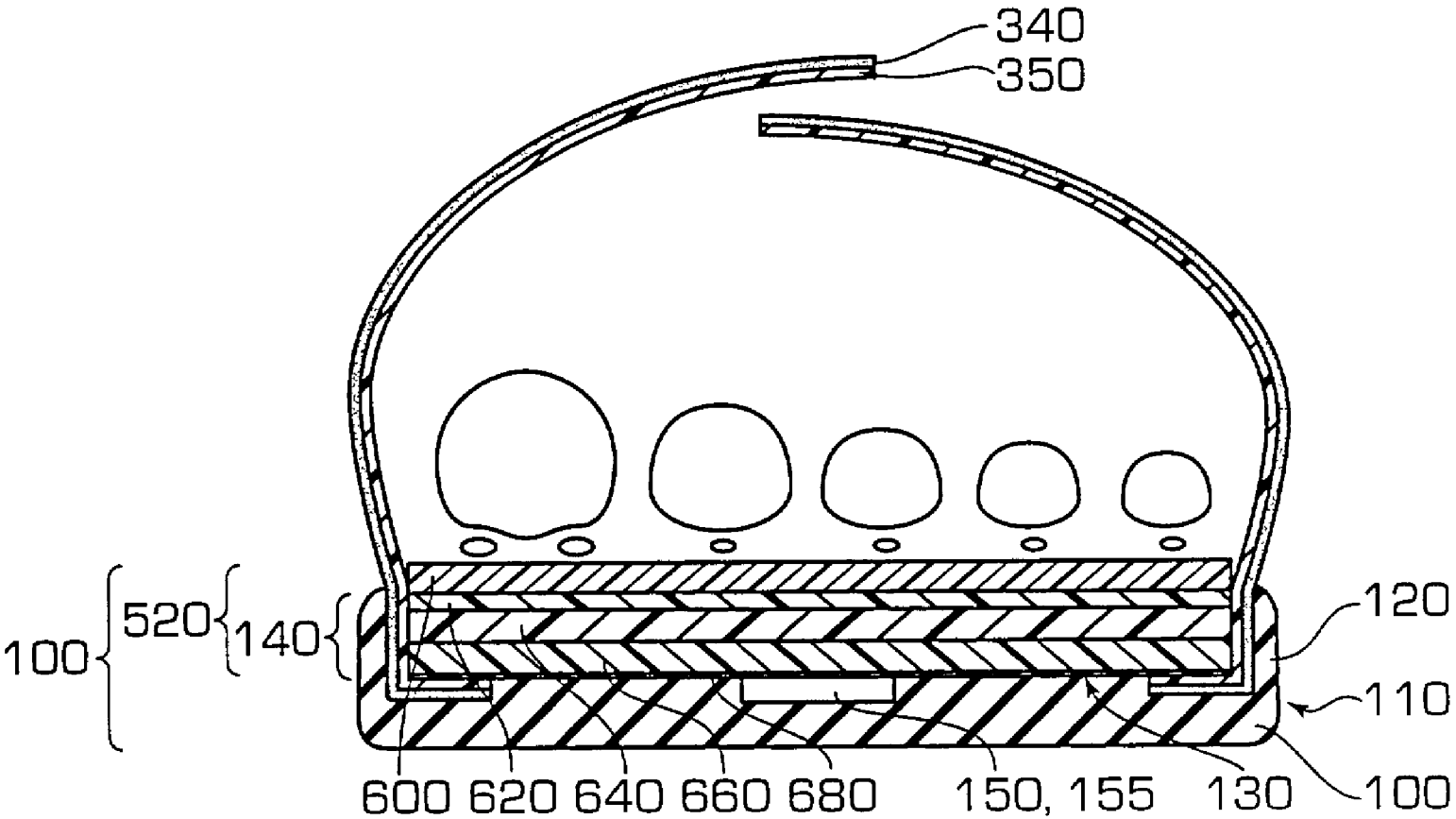
FIG. 3 is a cut-away or cross section of the foot and healing shoe showing the circumferential counter extending upward from the sole, and four (4) layers of multi-density insoles, as well as the layer of polywood and a metatarsal shank.

With reference to FIG. 3, the molded out sole 100 of the shoe or sandal 10 is designed with a circumferential counter 120 that extends ¼ to 1 inch onto the shoe upper 300 above the upper surface 130 of a base portion 110 of the outsole 100. Imbedded in the base portion 110 of the rocker bottom out sole 100 is the metatarsal shank 155, constructed of metal, plastic or other suitable material that begins near the distal ⅓ of the metatarsals (710, as shown in FIG. 5) extending across the metatarsal-phalangel joints to control motion in that portion of the foot. This out sole 100 and the circumferential counter 120, are molded in one piece and designed to add stability to the foot while providing space for the insole 500 including insole layers (generally, 520) of insole material (individually 600, 620, 640, 660), within the out sole cavity 140 to prevent shifting of the insole layers 520 and permit offloading of specific areas of the foot.

The insole layers 600, 620, 640 and 660 are constructed of Ethyl Vinyl Acetate (EVA) or other suitable material of varying densities. The cavity (pocket) 140 formed by the circumferential counter 120 also presents a lower profile in that the insole layers 520 are confined within the molded out sole 100 below the level of the upper portion of the shoe rather than in the shoe upper itself. The poly-wood layer 680, forming the foundation of the insole 500, is about 2 mm thick. The durometer (hardness) or relative density of the insole layers 600, 620, 640 and 660 are preferably within 5 degrees of the following example of the preferred embodiment but are not in anyway limited thereto.

TABLE 1

| Insoles Layer | Durometer | Thickness | Material |
|---|---|---|---|
| 600 | 26 | ¼ in. | soft EVA or Plastizote |
| 620 | 29 | ⅛ in. | high-density foam/soft Poron |
| 640 | 42 | ¼ in. | medium-density foam/EVA or Plastizote |
| 660 | 50 | ¼ in. | firm-density foam/EVA or Plastizote |

With reference to FIG. 4, the layers 520 of insole material 600, 620, 640 and 660 and the inventive out sole 100 provide the extra height (depth) necessary (as if these components were actually a part of the out sole) to create a rocker bottom sole. The rocker bottom 160 of the out sole 100 permits easy ambulation while at the same time allowing the patient to stand on the flat stable mid section 262 of the rocker bottom 160 of the out sole 100. The rocker apex 267 of the rocker bottom 160 of the out sole 100 is located at (just below) the fitting marker 270 or just proximal to the metatarsal heads (720, see FIGS. 5A & B) to reduce pressure from the metatarsal heads 720 and then tapers off toward the toe of the out sole in the toe section 261. The heel section 263 of the rocker bottom 160 of the out sole 100 is tapered at an oblique angle from mid-section 262 to the rear of the rocker bottom 160 of the out sole 100 in a manner to cause heel strike about mid-heel at the oblique angle 268 between the heel section 263 and mid section 262. The rocker bottom 160 combined with the metal or plastic metatarsal shank 155, allows the patient to ambulate comfortably while reducing motion of the foot thereby reducing the friction caused by the foot movement within the shoe.

Figure 5A:
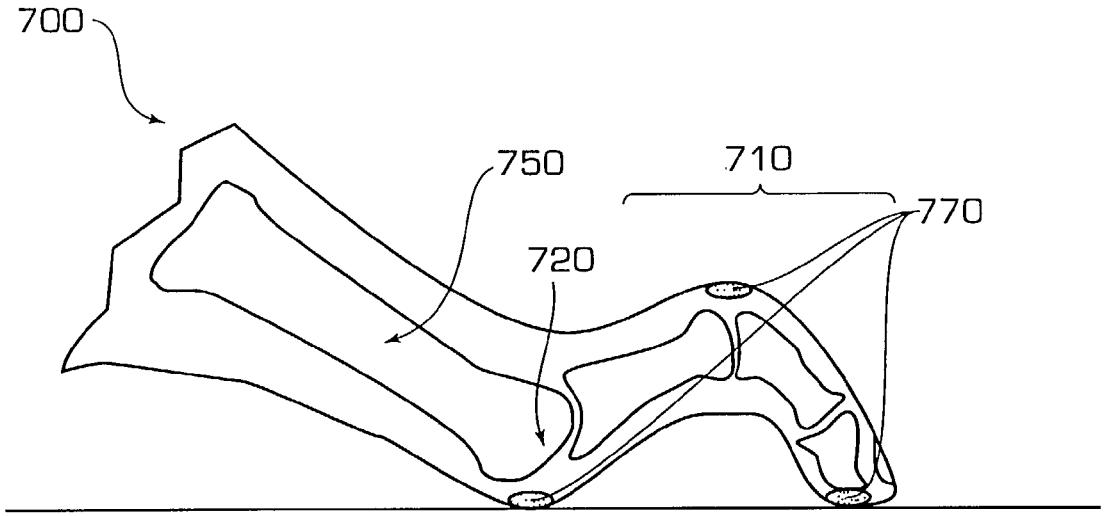
FIG. 5A is a cross section of a human foot illustrating the metatarsals and phalanges of the foot.

Referring now to FIGS. 5A & B, the shoe upper 300 having an inner lining 350 and an outer covering 340, as well as the insole layers 520 (600, 620, 640 and 660) of EVA, Poron and or other suitable material are designed to be altered as shown at 550 (see FIG. 2 at 390 for alteration of the upper), by or under the direction of the health care provider to offload weight from a specific area 770 of the foot. While the manner in which the insoles or shoe need to be altered is a clinical judgment for the health care provider, a method for altering the shoe is described hereinafter.

Figure 8:
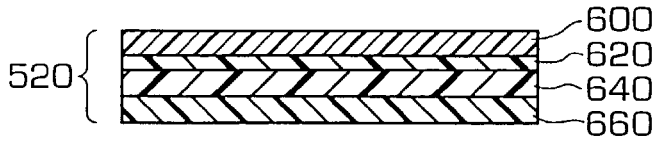
FIG. 8 illustrates the arrangement of the insole layers of the wound care shoe for treating a specific type of ailment.

Non-weight bearing ulcers generally occur over the posterior, medial or lateral aspect (on the top (dorsal) portion of the foot as opposed to the plantar aspect. For non-weight bearing ulcerations, regardless of grade (severity), the external cover of the shoe only is removed (see FIG. 2, element 390) leaving the soft inner lining intact to protect the lesion being treated and reduce the occurrence of window edema. Air holes may be added to the outer covering 340 in order to facilitate outer covering removal in those areas where ulcers are most likely to occur. Where such air holes are provided, the health care professional optimally should pass a small, blunt object (e.g., a large paperclip) from one air hole to the adjacent air hole in the outer covering, being careful not the penetrate the inner lining in order to remove a particular region of the outer covering without damaging the inner lining. Alternately, using a sharp instrument, the health care professional should cut away the portion of the outer covering surrounding (directly above) the lesion to be treated or between the air holes nearest the lesion in order to remove the required amount of outer covering. The initial cut should be below the level of the top of the area being removed (dorsally). A flat instrument or tongue depressor may then be inserted between the covering and the lining to prevent accidental cutting or damage to the lining when the covering is cut away. Insole layers 520 should optimally be arranged as indicated by FIG. 8 when no open ulcers are present. Should the ulcer or inflammation extend to the plantar surface of the foot, the insoles should be altered in the same manner as described below for the treatment of plantar (weight-bearing) ulcers.

Figure 5B:
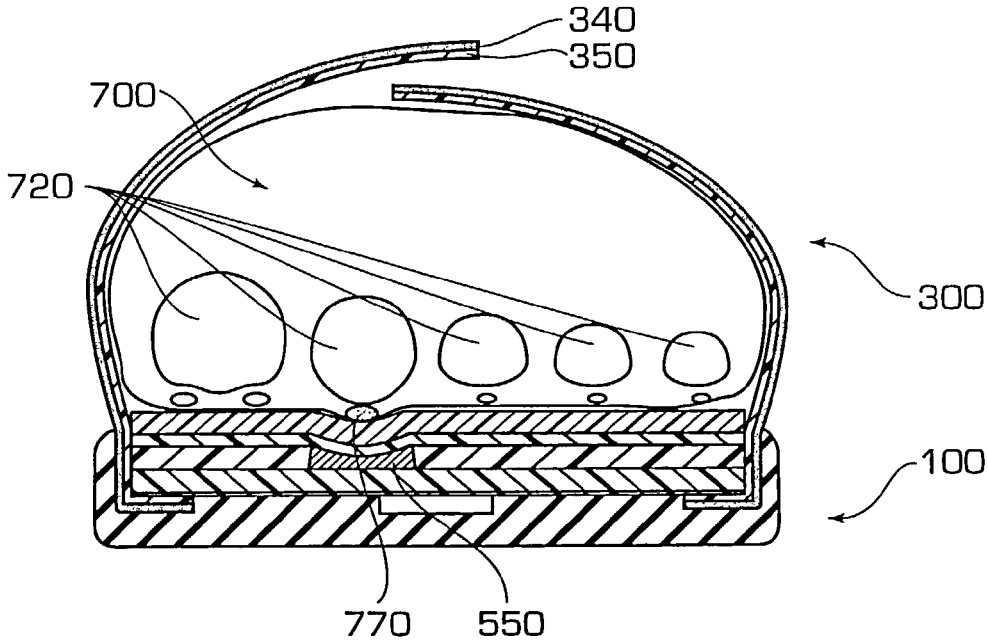
FIG. 5B is a cross section of the shoe and foot at the metatarsal head level illustrating an altered insole to remove pressure from a plantar lesion of the foot.
Figure 6:
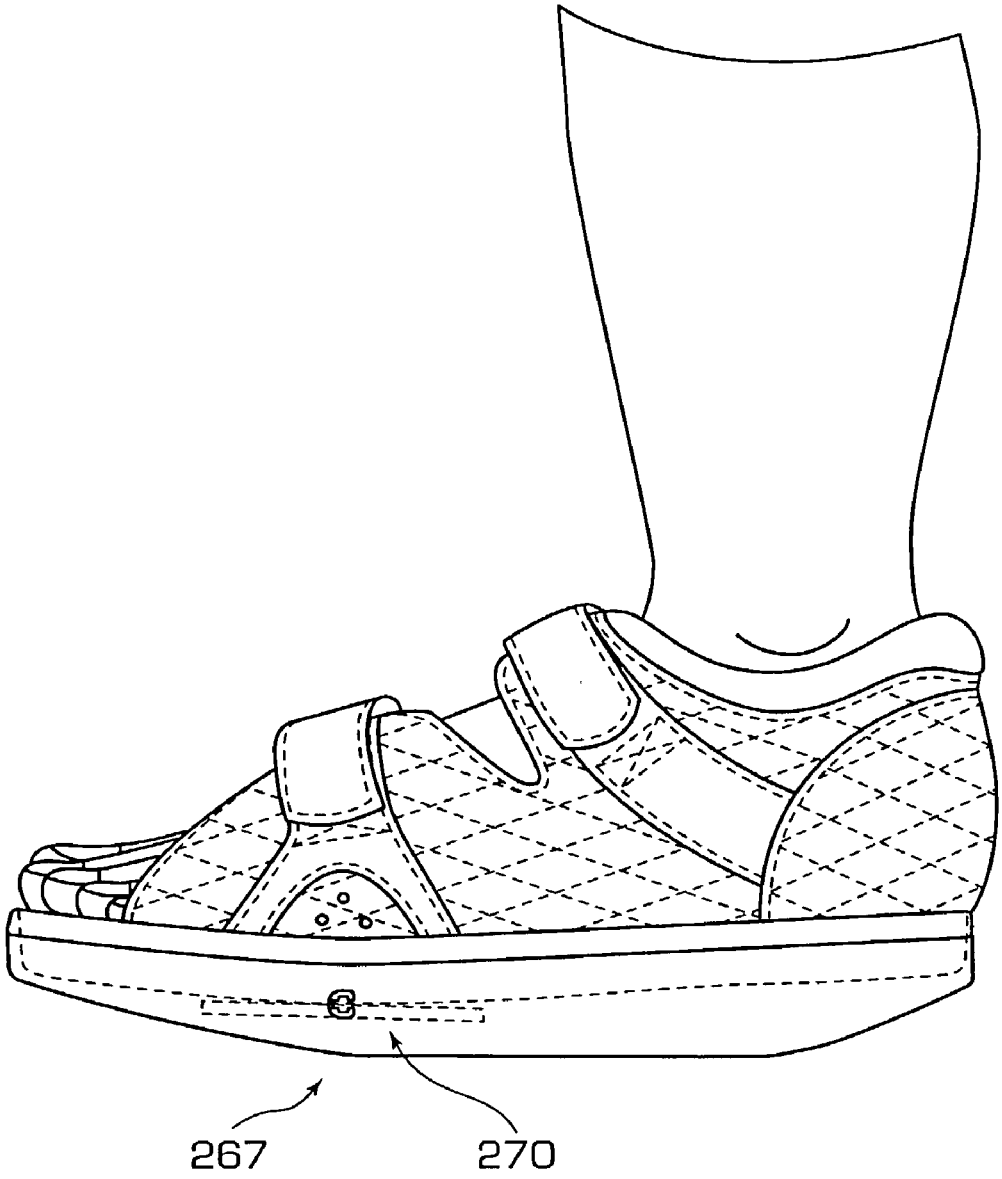
FIG. 6 is a side elevation of the wound care shoe showing the opposite side of the wound care shoe from FIG. 2.
Figure 10:
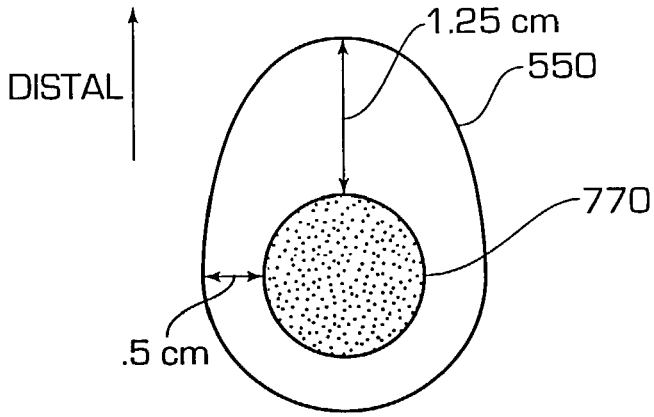
FIG. 10 illustrates a preferred cut out of at least one insole layer of the wound care shoe for treating a wound.
Figure 9:
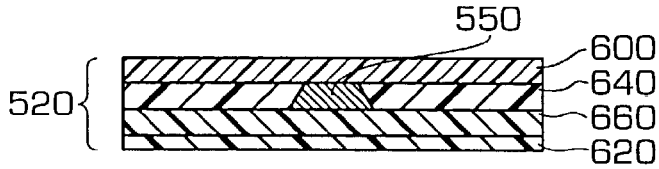
FIG. 9 illustrates the arrangement of the insole layers of the wound care shoe for treating an alternate specific type of ailment.
Figure 11:
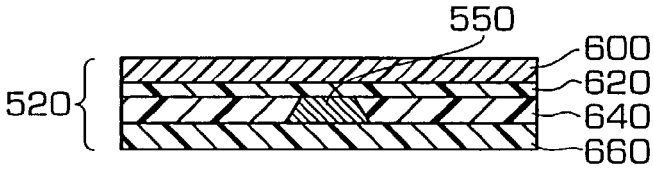
FIG. 11 illustrates the arrangement of the insole layers of the wound care shoe for treating another alternate type of ailment.

When treatment of weight-bearing ulcers of grade 0 and 1 on the Wagner Scale on the plantar surface of the foot is required, the insole layers 520 optimally should be placed in the order as indicated in FIG. 9. Using a sharp instrument such as a scalpel or utility knife, the health care professional should cut away an oval area (area to be removed 550) of the medium density insole layer 640 directly under the ulcer as shown in FIG. 5B and FIG. 9. The health care professional should skive the edges to an angle of approximately 30° so that the opening farther away from the foot is slightly larger than the opening nearer the plantar surface of the foot. The oval relief area should be approximately 0.5 cm larger than the ulcer and extend distally 1.25 cm as shown in FIG. 10. A hard, smooth-cutting surface should be used to obtain more accurate and safe cutting results. After the wound has closed, the insole layers should be rearranged as indicated in FIG. 11. The shoe can then be used as a household ambulation slipper.

Figure 12:
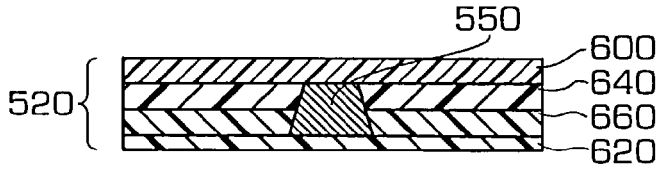
FIG. 12 illustrates the arrangement of the insole layers of the wound care shoe for treating yet another specific type of ailment.
Figure 13:
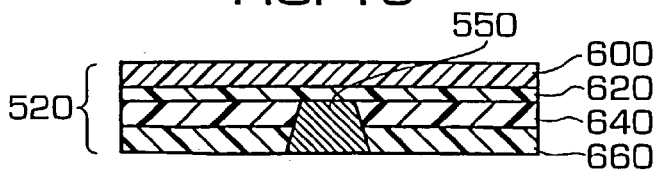
FIG. 13 illustrates the arrangement of the insole layers of the wound care shoe for treating still another type of ailment.

When treatment of weight-bearing ulcers of grade 2 and above on the Wagner Scale on the plantar surface of the foot is required, the insole layers 520 optimally should be placed in the order as indicated in FIG. 12. Using a sharp instrument such as a scalpel or utility knife, the health care professional should cut away an oval area 550 of the medium density insole layer 640 and the firm density insole layer 660 directly under the ulcer as shown in FIG. 5 (showing only the removal of medium density insole layer 640) and 12. The oval relief area should be approximately 0.5 cm larger than the ulcer and extend distally 1.25 cm as described previously with respect to FIG. 10. When the oval area is cut away from the medium density insole layer, the firm density insole layer or both, the opening in the insole should be slightly larger on the bottom (further from the wound) than the top (nearer the wound) in order to minimize pressure and shear to the ulcer margin. After the wound has closed, the insole layers should be rearranged as indicated in FIG. 13. The shoe can then be used as a household ambulation slipper.

Proper fitting of the Wound Care shoe is essential for optimal results. To this end, the fitting marker 270 as shown in FIG. 2 is molded into the out sole 100 to assist in proper fitting. The head of the first metatarsal (720 in FIGS. 5A & B) should be positioned such that it is slightly in front of the fitting marker 270 to ensure that the other metatarsal heads are just in front of the high point (rocker apex 267) of the rocker bottom 160 of the out sole 100 to reduce the weight-bearing load on the metatarsal heads and forefoot.

Figure 7:
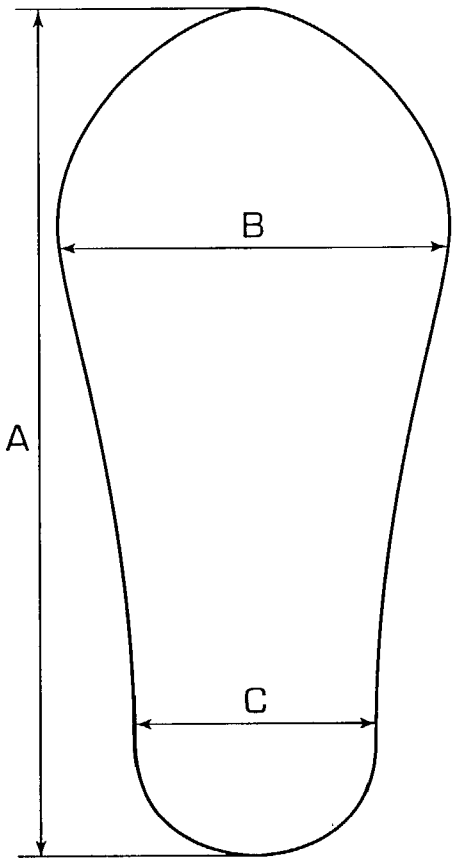
FIG. 7 illustrates the general shape of the out sole in a plantar aspect of the human foot, in conjunction with table 2.

Additionally, a variety of out sole dimensions are contemplated in order to accommodate a wide variety of foot shapes and sizes, as illustrated in FIG. 7 and described in table 2, below. All dimensions are in centimeters (cm).

TABLE 2

| | Out Sole Dimensions | | |
|---|---|---|---|
| | A | B | C |
| Small | 26.00 | 9.25 | 6.25 |
| Medium | 27.00 | 10.25 | 7.00 |
| Large | 28.25 | 10.50 | 7.50 |
| X-Large | 30.50 | 11.00 | 7.50 |
| XX-Large | 32.00 | 11.25 | 7.75 |

While the present invention and method for using same has been described using specific terms and preferred embodiments, such description is for illustrative purposes only, and it is understood that changes and variations may be made by one skilled in the art without deviating from the broad principles and teachings of the present invention which shall be limited solely by the scope of the claims appended hereto.

What is claimed is:

1. A medical shoe for use in supporting a patient's foot comprising:

an out sole;

an upper assembly secured to and partially surrounded by the out sole;

an insole assembly substantially enclosed by the out sole and the upper assembly;

the out sole having a base portion generally corresponding with the plantar aspect of a human foot and of varying thickness and having a substantially rectangular opening in a top surface thereof adapted for accommodating a metatarsal shank;

the out sole having a circumferential counter portion extending upward circumferentially from the top surface of the base portion of the out sole around the base portion of the out sole thereby providing a cavity in the out sole;

the upper assembly including a heel portion, an intermediate portion and a toe portion, the heel section and intermediate section integrally connected;

the upper assembly adapted to surround at least the heel, sides and dorsal portions of the human foot;

the upper assembly attached to the top surface of the base portion of the out sole and the circumferential counter of the out sole, and extending in a dorsal direction from the top surface of the base portion of the out sole along the circumferential counter;

the insole assembly having a plurality of insole layers disposed in the out sole cavity and surrounded by the upper assembly and the out sole circumferential counter;

the plurality of insole layers provided to include at least one of a plurality of differing insole layer thickness, materials, hardnesses and densities;

wherein each of the plurality of insole layers is separably removable, wherein said plurality of insole layers are stacked on top of one another, and said plurality of insole layers are capable of being rearranged so as to be stacked in different orders; and wherein the out sole circumferential counter prevents each of the plurality of insole layers from shifting within the out sole cavity when the insole layers are stacked in each of the different orders;

wherein said plurality of separably removable insole layers include at least three layers.

2. The medical shoe as claimed in claim 1, wherein the insole assembly includes at least a first and a second insole layer wherein the first and second layers are an Ethyl Vinyl Acetate (EVA) material, and the second layer has a durometer less than the first layer.

3. The medical shoe as claimed in claim 2, wherein the opening for the metatarsal shank is centered laterally and extends distally from a location substantially corresponding to the distal ⅓ of the metatarsals in a plantar aspect of a corresponding foot to be supported by the medical shoe; and wherein the metatarsal shank accommodated therein is comprised of one of a metallic material and a rigid plastic material.

4. The medical shoe as claimed in claim 3, wherein a bottom surface of the base portion of the out sole has a unique rocker shape, a rocker bottom, adapted to permit easy ambulation while also providing a stable platform for standing;

the rocker bottom having a flat mid-section in upwardly and rearwardly oblique relation to a tapered heel section and upwardly and forwardly oblique relation to a tapered toe section.

5. The medical shoe as claimed in claim 4, wherein the apex of the rocker bottom which is adapted to form the oblique angle between the mid-section and the tapered toe section is located just below a fitting marker just proximal to the metatarsal heads, the oblique angle between the tapered heel section and the mid-section is located just below mid-heel, and the taper of the heel section is adapted so as to cause the heel to strike at the oblique angle between the tapered heel section and the mid-section.

6. The medical shoe as claimed in claim 1, wherein the opening for the metatarsal shank is centered laterally and extends distally from a location substantially corresponding to the distal ⅓ of the metatarsals in a plantar aspect of a corresponding foot to be supported by the medical shoe, and wherein the metatarsal shank accommodated therein is comprised of one of a metallic material and a rigid plastic material.

7. The medical shoe as claimed in claim 6, wherein a bottom surface of the base portion of the out sole has a unique rocker shape, a rocker bottom, adapted to permit easy ambulation while also providing a stable platform for standing;

the rocker bottom having a flat mid-section in upwardly and rearwardly oblique relation to a tapered heel section and upwardly and forwardly oblique relation to a tapered toe section.

8. The medical shoe as claimed in claim 7, wherein the apex of the rocker bottom which is adapted to form the oblique angle between the mid-section and the tapered toe section is located just below a fitting marker just proximal to the metatarsal heads, the oblique angle between the tapered heel section and the mid-section is located just below mid-heel, and the taper of the heel section is adapted so as to cause the heel to strike at the oblique angle between the tapered heel section and the mid-section.

9. A medical shoe for use in supporting a patient's foot comprising:

an out sole;

an upper assembly secured to and partially surrounded by the out sole;

an insole assembly substantially enclosed by the out sole and the upper assembly;

the out sole having a base portion generally corresponding with the plantar aspect of a human foot and of varying thickness and having a substantially rectangular opening in a top surface thereof adapted for accommodating a metatarsal shank;

the out sole having a circumferential counter portion extending upward circumferentially from the top surface of the base portion of the out sole around the base portion of the out sole thereby providing a cavity in the out sole;

the upper assembly including a heel portion, an intermediate portion and a toe portion, the heel section and intermediate section integrally connected;

the upper assembly adapted to surround at least the heel, sides and dorsal portions of the human foot;

the upper assembly attached to the top surface of the base portion of the out sole and the circumferential counter of the out sole, and extending in a dorsal direction from the top surface of the base portion of the out sole along the circumferential counter;

the insole assembly having a plurality of insole layers disposed in the out sole cavity and surrounded by the upper assembly and the out sole circumferential counter;

the plurality of insole layers provided to include at least one of a plurality of differing insole layer thickness, materials, hardnesses and densities;

wherein the insole assembly includes at least a first and a second insole layer wherein the first and second layers are an Ethyl Vinyl Acetate (EVA) material, and the second layer has a durometer less than the first layer;

wherein the insole assembly includes the first and second insole layers, and a third and a fourth insole layer wherein the third layer is a Poron material with a durometer less than the second layer and the fourth layer is an EVA material with a durometer less than the third layer; and wherein the first, second, third, and fourth layers may be assembled in any order as determined by a health care professional.

10. The medical shoe as claimed in claim 9, wherein the opening for the metatarsal shank is centered laterally and extends distally from a location substantially corresponding to the distal ⅓ of the metatarsals in a plantar aspect of a corresponding foot to be supported by the medical shoe; and wherein the metatarsal shank accommodated therein is comprised of one of a metallic material and a rigid plastic material.

11. The medical shoe as claimed in claim 10, wherein a bottom surface of the base portion of the out sole has a unique rocker shape, a rocker bottom, adapted to permit easy ambulation while also providing a stable platform for standing;

the rocker bottom having a flat mid-section in upwardly and rearwardly oblique relation to a tapered heel section and upwardly and forwardly oblique relation to a tapered toe section.

12. The medical shoe as claimed in claim 11, wherein the apex of the rocker bottom which is adapted to form the oblique angle between the mid-section and the tapered toe section is located just below a fitting marker just proximal to the metatarsal heads, the oblique angle between the tapered heel section and the mid-section is located just below mid-heel, and the taper of the heel section is adapted so as to cause the heel to strike at the oblique angle between the tapered heel section and the mid-section.

13. The medical shoe as claimed in claim 12, wherein the toe portion of the upper assembly is comprised of one of an open toe portion and a closed toe portion, the closed toe portion adapted to surround the metatarsal and phalangel portions of the human foot and attached to the base portion and circumferential counter of the out sole in the same manner as the heel portion and intermediate portion of the upper assembly.

14. The medical shoe as claimed in claim 13, wherein the intermediate portion of the upper assembly includes inner and outer intermediate flaps adapted to cover the dorsal portion of the human foot, and connection means for interconnecting the inner and outer intermediate flaps.

15. The medical shoe as claimed in claim 14, wherein the connection means is comprised of one of buttons and button holes, snaps, hook and loop fastener patches, and holes with corresponding laces.

16. The medical shoe as claimed in claim 15, wherein the connection means is comprised of straps included a first and a second strap, each of the inner and outer flaps including a first and a second ring attached to the respective flap with each first and second ring aligned transversely with one another, and the first and second straps are provided threaded between each of the first and second rings respectively to interconnect the flaps by a pressing and a tension force;

the straps comprising one of fastening mechanisms of hook and loop fasteners, button fasteners and snap fasteners.

17. The medical shoe as claimed in claim 10, wherein the toe portion of the upper assembly is comprised of one of an open toe portion and a closed toe portion, the closed toe portion adapted to surround the metatarsal and phalangel portions of the human foot and attached to the base portion and circumferential counter of the out sole in the same manner as the heel portion and intermediate portion of the upper assembly.

18. The medical shoe as claimed in claim 17, wherein the intermediate portion of the upper assembly includes inner and outer intermediate flaps adapted to cover the dorsal portion of the human foot, and connection means for interconnecting the inner and outer intermediate flaps.

19. The medical shoe as claimed in claim 18, wherein the connection means is comprised of one of buttons and button holes, snaps, hook and loop fastener patches, and holes with corresponding laces.

20. The medical shoe as claimed in claim 19, wherein the connection means is comprised of straps included a first and a second strap, each of the inner and outer flaps including a first and a second ring attached to the respective flap with each first and second ring aligned transversely with one another, and the first and second straps are provided threaded between each of the first and second rings respectively to interconnect the flaps by a pressing and a tension force;

the straps comprising one of fastening mechanisms of hook and loop fasteners, button fasteners and snap fasteners.

21. The medical shoe as claimed in claim 9, wherein the toe portion of the upper assembly is comprised of one of an open toe portion and a closed toe portion, the closed toe portion adapted to surround the metatarsal and phalangel portions of the human foot and attached to the base portion and circumferential counter of the out sole in the same manner as the heel portion and intermediate portion of the upper assembly.

22. The medical shoe as claimed in claim 21, wherein the intermediate portion of the upper assembly includes inner and outer intermediate flaps adapted to cover the dorsal portion of the human foot, and connection means for interconnecting the inner and outer intermediate flaps.

23. The medical shoe as claimed in claim 22, wherein the connection means is comprised of one of buttons and button holes, snaps, hook and loop fastener patches, and holes with corresponding laces.

24. The medical shoe as claimed in claim 23, wherein the connection means is comprised of straps included a first and a second strap, each of the inner and outer flaps including a first and a second ring attached to the respective flap with each first and second ring aligned transversely with one another, and the first and second straps are provided threaded between each of the first and second rings respectively to interconnect the flaps by a pressing and a tension force;

the straps comprising one of fastening mechanisms of hook and loop fasteners, button fasteners and snap fasteners.

25. A medical shoe for use in supporting a patient's foot comprising:

an out sole;

an upper assembly secured to and partially surrounded by the out sole;

an insole assembly substantially enclosed by the out sole and the upper assembly;

the out sole having a base portion generally corresponding with the plantar aspect of a human foot and of varying thickness and having a substantially rectangular opening in a top surface of the base portion thereof adapted for accommodating a metatarsal shank;

the opening for the metatarsal shank centered laterally and extending distally from a location substantially corresponding to the distal ⅓ in a plantar aspect of the metatarsals of the foot to be supported by the medical shoe, and the metatarsal shank accommodated therein is comprised of one of a metallic material and a rigid plastic material;

the out sole having a circumferential counter portion extending upward circumferentially from the top surface of the base portion thereof around the base portion of the out sole thereby providing a cavity in the out sole;

the upper assembly adapted to surround at least the heel, sides and dorsal portions of the human foot, the upper assembly including a heel portion, an intermediate portion and a toe portion, the heel portion and intermediate portion integrally connected, the toe portion comprised of one of an upper toe portion and a closed toe portion, the closed toe portion adapted to surround the metatarsal and phalangel portions of the human;

the upper assembly attached to the top surface of the base portion of the out sole and the circumferential counter of the out sole, and extending in a dorsal direction from the top surface of the base portion of the out sole along the circumferential counter;

the insole assembly having a plurality of insole layers disposed in the out sole cavity and surrounded by the upper assembly and the out sole circumferential counter;

the plurality of insole layers provided to include a first insole layer, a second insole layer a third insole layer and a fourth insole layer wherein the first and second layers are an Ethyl Vinyl Acetate (EVA) material and the second layer has a durometer less than the first layer, the third layer is a Poron material with a durometer less than the second layer, and the fourth layer is an EVA material with a durometer less than the third layer, and the first, second, third, and fourth layers may be assembled in any order as determined by a health care provider;

the base portion of the out sole having a rocker bottom surface, adapted to permit easy ambulation while also providing a stable platform for standing, the rocker bottom having a flat mid-section in upwardly and rearwardly oblique relation to a tapered heel section and upwardly and forwardly oblique relation to a tapered toe section, the apex of the rocker bottom adapted to form the oblique angle between the mid-section and the tapered toe section and located just below a fitting marker just proximal to the metatarsal heads, the oblique angle between the tapered heel section and the mid-section located just below mid-heel, the taper of the heel section adapted so as to cause the heel to strike at the oblique angle between the tapered heel section and the midsection, the intermediate portion of the upper assembly including inner and outer intermediate flaps adapted to cover the dorsal portion of the human foot, and a first and second strap adapted for using a hook and loop fastening mechanism for interconnecting the inner and outer intermediate flaps, each of the inner and outer flaps including a first and a second ring attached to the respective flap with each first and second ring aligned transversely with one another, and the first and second straps are provided threaded between each of the first and second rings respectively to interconnect the flaps by a pressing and a tension force.

26. A method, comprising providing the medical shoe of claim 25; and fitting the shoe such that the head of the first metatarsal of the human foot is positioned slightly in front of the fitting marker of the out sole to ensure that the other metatarsal heads of the human foot are just in front of the rocker apex of the rocker bottom of the out sole to reduce a weight-bearing load on the metatarsal heads and forefoot.

27. The method of claim 26, further comprising treating a non-weight bearing area by removing a portion of the external cover of the upper portion of the shoe surrounding and directly above the area to be treated without removing or damaging the soft inner lining so that the area being treated is protected.

28. The method of claim 26, further comprising treating a weight bearing area by removing an oval area of at least one of the insole layers directly under the area to be treated, wherein the edges of oval area are skived to an angle of approximately 30° so that the opening farther away from the area to be treated is slightly larger than the opening nearer the area to be treated, and the upper limit of the oval area is approximately 0.5 cm larger than the area to be treated and extends distally 1.25 cm from the area to be treated.

29. A method, comprising providing the medical shoe of claim 25; and treating a non-weight bearing area by removing a portion of the external cover of the upper portion of the shoe surrounding and directly above the area to be treated without removing or damaging the soft inner lining so that the area being treated is protected.

30. A method, comprising providing the medical shoe of claim 25; and treating a weight bearing area by removing an oval area of at least one of the insole layers directly under the area to be treated, wherein the edges of oval area are skived to an angle of approximately 30° so that the opening farther away from the area to be treated is slightly larger than the opening nearer the area to be treated, and the upper limit of the oval area is approximately 0.5 cm larger than the area to be treated and extends distally 1.25 cm from the area to be treated.

31. An assembly of a healing shoe having an upper assembly, an out sole assembly with a cavity therein, and an out sole circumferential counter, comprising:

a plurality of separably removable insole layers disposed in the out sole cavity;

the separably removable insole layers surrounded by the upper assembly and the out sole circumferential counter integrally attached to the out sole assembly and the upper assembly, the insole assembly including an oval opening within at least one of the insole layers adapted to be directly under an area of a human foot;

the plurality of separably removable insole layers provided to include at least one of a plurality of differing insole layer thickness, materials, hardnesses and densities, wherein said insole layers are stacked on top of one another, and said insole layers are capable of being rearranged so as to be stacked in different orders; and wherein the out sole circumferential counter prevents each of the plurality of insole layers from shifting within the out sole cavity when the insole layers are stacked in each of the different orders;

wherein said plurality of separably removable insole layers include at least three layers.

32. The assembly of claim 31, wherein edges of the oval opening are skived such that the opening farther away from the area to be treated is slightly larger than the opening nearer the area to be treated.

33. A healing shoe for use in supporting a patient's foot comprising:

an out sole;

a circumferential counter portion attached to and extending upward circumferentially from the out sole;

a fitting marker provided on a side surface of the out sole for fitting of the healing shoe to a human foot, said fitting marker being molded into the side surface of the out sole and being provided below the circumferential counter.

34. The healing shoe of claim 33, wherein the fitting marker is provided on the medial side surface of the out sole approximately ⅓ the longitudinal distance between a front surface of a tapered toe section of the shoe and rear surface of a tapered heel section of the shoe corresponding with an apex of a bottom surface of the of the out sole between a flat mid-section of the bottom surface and the tapered toe section in upwardly and forwardly oblique relation the flat mid-section, the fitting marker is provided for longitudinal positioning of a metatarsal-phalangel joint of the human foot within the healing shoe.

35. A method, comprising providing the healing shoe of claim 34, wherein at least one additional insole layer may be added in the vicinity of an area of the human foot to be treated, the at least one additional insole layer having at least one of an insole layer thickness, material, hardness and density different from the plurality of insole layers of the insole assembly.

36. A method, comprising providing the healing shoe of claim 33; and fitting the healing shoe such that a head of a first metatarsal of a human foot is positioned slightly in front of the fitting marker provided on the surface of the out sole to ensure that other metatarsal heads of the human foot are just in front of a rocker apex of a rocker bottom of the out sole assembly to reduce a weight-bearing load on the metatarsal heads and a forefoot.

37. A method, comprising providing the healing shoe of claim 33; and fitting the healing shoe such that a head of a first metatarsal of a human foot is positioned slightly in front of the fitting marker provided on the surface of the out sole assembly to ensure that other metatarsal heads of the human foot are just in front of a rocker apex of a rocker bottom of the out sole assembly to reduce a weight-bearing load on the metatarsal heads and forefoot.

38. A healing shoe having an upper assembly, an out sole assembly with a cavity therein, and an out sole circumferential counter, comprising:

an insole assembly disposed in the out sole cavity having a plurality of distinct insole layers;

the insole assembly surrounded by the upper assembly and the out sole circumferential counter integrally attached to the out sole assembly and the upper assembly and extending upward circumferentially from the out sole assembly;

each of the plurality of insole layers including at least one of a plurality of differing insole layer thickness, materials, hardnesses and densities; and a fitting marker provided on a side surface of the out sole assembly, said fitting marker being molded into the side surface of the out sole and being provided below the circumferential counter.

* * * * *